US008002215B2

(12) United States Patent
Repp et al.

(10) Patent No.: US 8,002,215 B2
(45) Date of Patent: Aug. 23, 2011

(54) REEL CHANGER HAVING A HOLDER FOR SUPPORTING A MATERIAL REEL WITH A WINDING SLEEVE

(75) Inventors: Johannes Matthias Rudolf Repp, Erlabrunn (DE); Karl Richard Rösch, Neubrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 12/736,672

(22) PCT Filed: Feb. 16, 2009

(86) PCT No.: PCT/EP2009/051793

§ 371 (c)(1),
(2), (4) Date: Oct. 29, 2010

(87) PCT Pub. No.: WO2009/138258

PCT Pub. Date: Nov. 19, 2009

(65) Prior Publication Data

US 2011/0042505 A1 Feb. 24, 2011

(30) Foreign Application Priority Data

May 15, 2008 (DE) ..... 10 2008 001 796

(51) Int. Cl.
*B65H 49/20* (2006.01)

(52) U.S. Cl. ..... 242/596.7; 242/599.4

(58) Field of Classification Search ..... 242/596, 242/596.1, 596.4, 596.5, 596.6, 596.7, 597, 242/597.1, 597.6, 599, 599.4, 611, 533.7, 242/564, 564.5

See application file for complete search history.

(56) References Cited

U.S. PATENT DOCUMENTS

| | | | | |
|---|---|---|---|---|
| 3,224,702 | A | 12/1965 | Jones et al. | |
| 5,651,511 | A | 7/1997 | Crowley et al. | |
| 6,786,443 | B2 * | 9/2004 | Trutschel | 242/533.7 |
| 6,796,234 | B1 | 9/2004 | Busshoff | |
| 7,258,300 | B2 * | 8/2007 | Rosch | 242/596.7 |
| 2005/0211820 | A1 * | 9/2005 | Rosch | 242/596 |
| 2007/0170299 | A1 | 7/2007 | Ritter | |

FOREIGN PATENT DOCUMENTS

| | | | | |
|---|---|---|---|---|
| DE | 2612375 | A1 | 10/1977 | |
| DE | 10224839 | A1 | 1/2004 | |
| EP | 1708942 | B1 | 10/2006 | |
| EP | 1731464 | A2 | 12/2006 | |
| GB | 1549370 | | 8/1979 | |
| JP | 06024651 | * | 2/1994 | 242/596.1 |

* cited by examiner

*Primary Examiner* — William A Rivera
(74) *Attorney, Agent, or Firm* — Jones, Tullar & Cooper, P.C.

(57) ABSTRACT

A reel changer is usable for supporting a reel of material that is wound on a winding sleeve. The reel holder includes a carrier journal and a plurality of driver elements. These driver elements are arranged such that they engage in a front of the winding sleeve. The number of these driver elements which can engage in the front of the winding sleeve can be varied.

18 Claims, 5 Drawing Sheets

REEL CHANGER HAVING A HOLDER FOR SUPPORTING A MATERIAL REEL WITH A WINDING SLEEVE

CROSS-REFERENCE TO RELATED APPLICATIONS

This application is the U.S. national phase, under 35 U.S.C. 371 of PCT/EP2009/051793, filed Feb. 16, 2009; published as WO 2009/138258 A1 on Nov. 19, 2009, and claiming priority to DE 10 2008 001 796.5, filed May 15, 2008, the disclosures of which are expressly incorporated herein by reference.

FIELD OF THE INVENTION

The present invention is directed to a reel changer having a holder for supporting a material reel with a winding sleeve. The holder has a support journal and a number of driver elements. These driver elements are arranged to engage an end support of the winding sleeve and act in a direction parallel to a rotational axis of the holder.

BACKGROUND OF THE INVENTION

Clamping cones for use in holding winding components are quite well known, particularly in the printing industry. In axleless reel support systems, suitable clamping cones are inserted into the sleeves of supported material reels using a motorized mechanism. In this process, clamping jaws or driver elements are then pressed into the sleeve material, thereby producing a positive connection, and a frictional connection between the clamping cone and the winding sleeve. Such a connection ensures an optimal transmission of torque from the drive of the winding component to the material reel.

A reel changer for a web-fed rotary printing press, which reel changer has a drive with at least one electric motor, is known from EP 17 08 942 B1. The electric motor drives a material reel on which a web of material is wound, while that reel is being held on a holder in the reel changer. The rotor of the electric motor, which may be embodied as a synchronous motor, has poles comprising permanent magnets. A drive shaft of the synchronous motor can be engaged with the material reel to transmit torque directly to the material reel. For this purpose, driver elements on the drive shaft are especially used, which driver elements are usable to transmit torque to the material reel through a positive and frictional connection.

Driver elements which function axially are also known. Such drive elements may be engaging with the winding sleeve at an end surface of the winding sleeve.

For example, DE 26 12 375 A1 describes cutting edges, which cutting edges are arranged along an outwardly extending flange of the supporting sleeve and on the reel side. These cutting edges ensure that, for example, when there is a change in direction of torque, no slippage will occur between the winding sleeve and the supporting sleeve.

Different winding sleeves, having different material properties, are used for different types and widths of material reels. Sleeve materials can also have different hardnesses. When harder sleeve types are being used, the available uploading force may not be sufficient to force the cone and the end-surface driver all the way into the winding sleeve. Therefore, a complete uploading process and the requisite torque transmission can no longer be ensured.

To make full use of machinery such as is typically used in the printing industry, it is sometimes necessary to process material reels having different configurations in a single production run of the machinery, or in various successive production runs of the machinery. This is especially the case with smaller web-processing systems or with smaller printing establishments. Until now, in order for different types of winding sleeves to be processed, different reel changers have had to be provided within one system. Alternatively, a time-consuming reconfiguration of the sole reel changer has had to be performed, thus resulting in long down times and increased production costs. One example of this would be in the processing of winding sleeves having different hardnesses.

DE 102 24 839 A1 discloses a mandrel for a reel changer. A holding element engages in the inner surface of a sleeve of a material reel and driver elements engage in the end surface of the sleeve of the material reel. Such driver elements extend through a movable switching ring.

SUMMARY OF THE INVENTION

The object of the present invention is to enable material reels having winding sleeves of different hardnesses to be loaded into a reel changer, and without a costly reconfiguration of the reel changer being required for this purpose.

The problem is solved in accordance with the present invention by the provision of a reel changer having a holder for use in supporting a material reel with a winding sleeve. The holder includes a support journal and a number of driver elements. These driver elements are arranged to engage an end surface of the winding sleeve. The number of driver elements which engage the sleeve's end surface can be varied.

The benefits to be achieved by the present invention consist especially in that different types of material reels with sleeve materials having different hardnesses can be uploaded in a simple manner, using a single reel changer. This can be accomplished without requiring additional time and without requiring costly reconfiguration of the reel changer. The solution, in accordance with the present invention, is easy to produce and easy to manipulate.

A holder, which is preferably provided as a clamping cone, of a reel changer, includes a support journal, which preferably tapers toward its unattached end, and is preferably also provided with a sleeve mounting surface, against which an end surface of a winding sleeve rests, as the winding sleeve is being uploaded. On the sleeve mounting surface, a plurality of driver elements are provided. These driver elements are forced into the sleeve material at the end surface of the winding sleeve and contribute to torque transmission to the winding sleeve.

The support journal can also have radially projecting driver elements or clamping jaws. These are typically radially adjustable and act on the inner surface of the winding sleeve.

At least one of the driver elements which is provided on the sleeve mounting surface can be retracted at least partially into the sleeve mounting surface. Depending upon the sleeve material that is used and upon its hardness, the number of driver elements to be used can be varied. Preferably, the one or more of the retractable driver elements can be retracted completely into the sleeve mounting surface.

When a winding sleeve, which is made of a soft material, is used, more of the driver elements, which are provided on the sleeve mounting surface, should be used than would be necessary in connection with a winding sleeve which is made of a hard material. The driver elements are preferably arranged on the sleeve mounting surface in a circular pattern and are located to be receivable in an end surface area of the winding sleeve of the material reel which is to be uploaded onto the reel changer. Preferably, a total of six driver elements are provided. The area of each such driver element that acts on the end surface area of the winding sleeve is preferably embodied as having flat, sharp cutting edges, which cutting edges are able to penetrate easily into the winding sleeve. Alternatively, the driver elements can be embodied as conical, cylindrical, or pyramidal in shape. The individual driver elements can also be differently embodied. In particular, the retractable driver elements can be adapted to be insertable into harder winding sleeves.

In one preferred embodiment of the present invention, half of the total number of driver elements provided are retractable. Preferably every second such driver element is retractable.

It is also possible, in accordance with the present invention, for the driver elements to be retracted in groups or individually, thereby allowing multiple graduated stages of driver elements for use with sleeve materials which may vary in sleeve hardness.

In one preferred embodiment of the present invention, the one or more retractable driver elements are axially displaceable and are flexibly mounted in a body of the clamping cone. Rather than having a direct mounting in the clamping cone, the one or more retractable driver elements could also be mounted in a sleeve, which sleeve is located on the bearing side of the clamping cone. The retractable driver elements are preferably flattened at their end which is located in the body of the clamping cone. The flattened end of each such retractable driver element is guided by at least one guide edge, thereby securing the retractable driver elements against rotation within the body. The guide edge can be located either in the body or on another component. This embodiment is particularly advantageous for retractable driver elements that are embodied as having flat cutting edges in their area that acts on the winding sleeve.

The status of the one or more of the retractable driver elements can be switched between "ACTIVE" and "PASSIVE."

In the active status, the axial displacement of the one or more retractable driver elements is blocked. The one or more of the retractable driver elements therefore projects out of the sleeve mounting surface. During uploading of a winding sleeve, this active status drive element or elements is pressed into the end surface of the winding sleeve. In the passive status, the driver element or elements yields, typically axially, to the pushed on winding sleeve, since it is being retracted against a spring force into the sleeve mounting surface. Once the empty winding sleeve has been stripped off, the retractable driver element, which is in its passive status, is moved back to its original position by the spring.

The switch between "ACTIVE" and "PASSIVE" is achieved by the use of a rotatable switching element. This rotatable switching element, in the preferred embodiment, is embodied as a rotatable switching ring. It will be described in greater detail in the description of the preferred embodiment.

The surface of the rotatable switching ring which faces the driver elements forms a blocking surface, which blocking surface blocks the axial movement of the retractable driver element. The rotatable switching ring also has an opening, which, in the passive status, is positioned in such a way that the retractable driver element is able to pass through this opening in the axial direction of the clamping cone.

The clamping cone can be driven either directly or indirectly in the reel changer. For direct driving, the clamping cone can be embodied as forming a single piece with the rotor of the drive motor. For indirect driving, the clamping cone can be driven by a drive assembly such as a toothed belt, for example.

A reel changer in accordance with the present invention is provided particularly for a web-fed rotary printing press and it comprises essentially a drive unit for rotationally driving a material reel which has been wound onto a winding sleeve, which winding sleeve can be loaded into the reel changer. A clamping cone, which can be driven by the drive unit, is used to upload the material reel.

BRIEF DESCRIPTION OF THE DRAWINGS

A preferred embodiment of the present invention is shown in the set of drawings and will be specified in greater detail in what follows.

The drawings show.

DESCRIPTION OF THE PREFERRED EMBODIMENT

Figure 1:
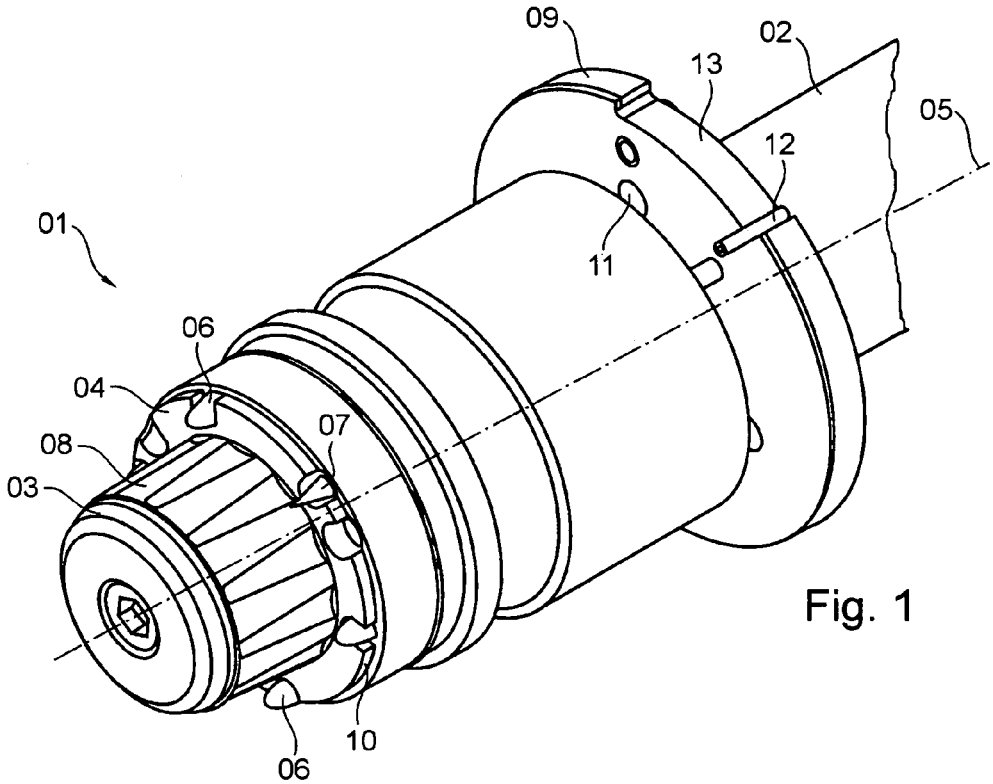
FIG. 1 a perspective representation of a preferred embodiment of a clamping cone, in an active status with an axially shiftable switching ring pushed back.

FIG. 1 shows a holder 01, preferably a clamping cone 01, which is provided for use in a reel changer, and preferably in a reel changer that is usable in a web-fed rotary printing press.

The clamping cone 01 is attached to a rotatable mounted shaft 02, which can be driven or which can be mounted so as to freely rotate in the roll stand. In the depicted embodiment, the body of the clamping cone 01 is configured to form a single piece with the shaft 02.

Figure 2:
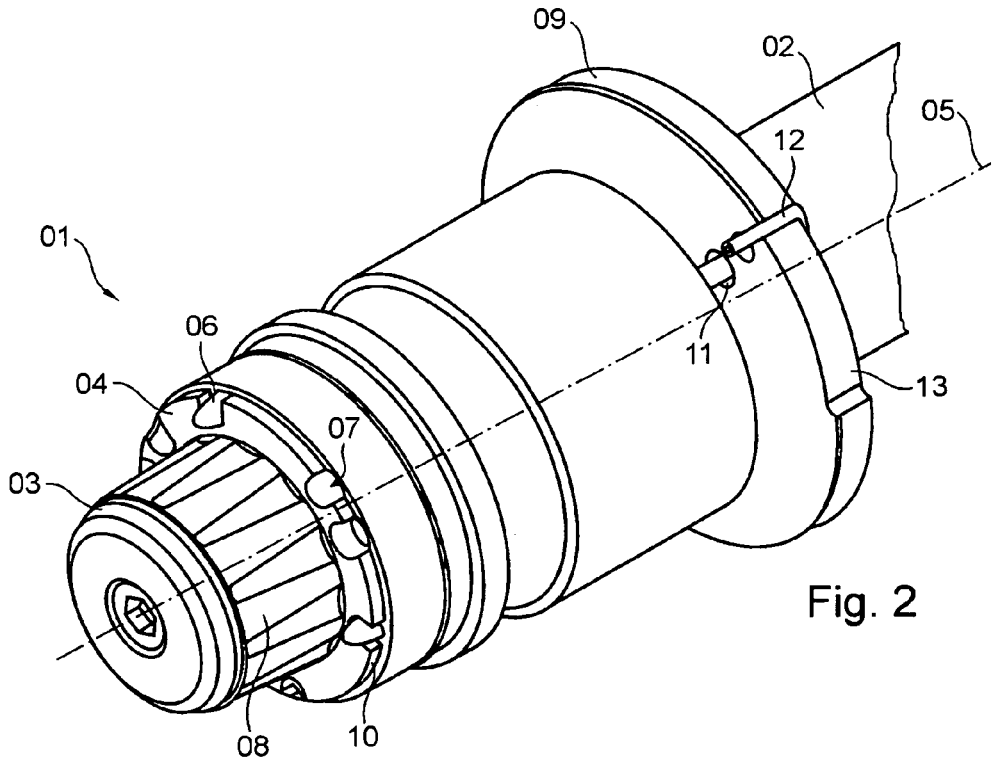
FIG. 2 the clamping cone according to FIG. 1 in a passive status with the axially shiftable switching ring pushed back.
Figure 5:
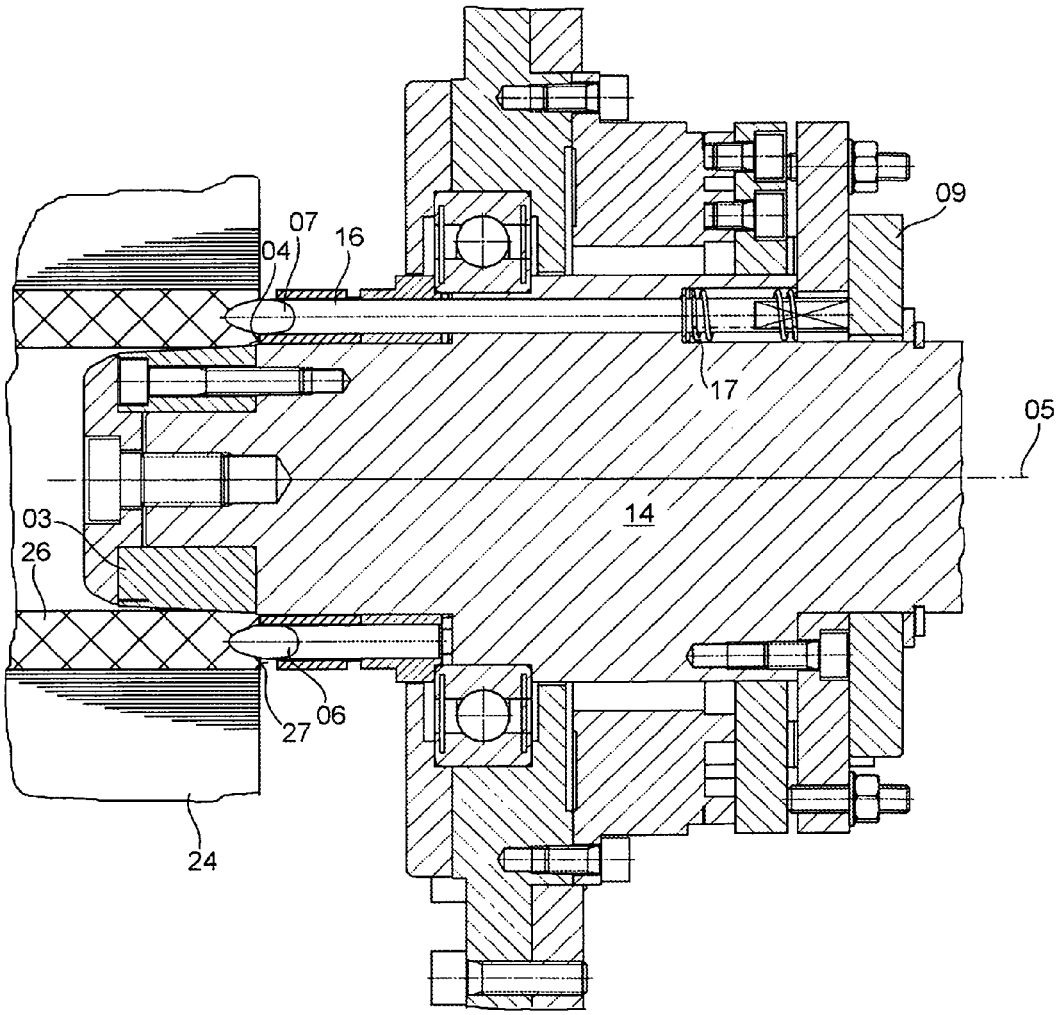
FIG. 5 a longitudinal cross-sectional representation of the clamping cone in a first, active operating status.
Figure 6:
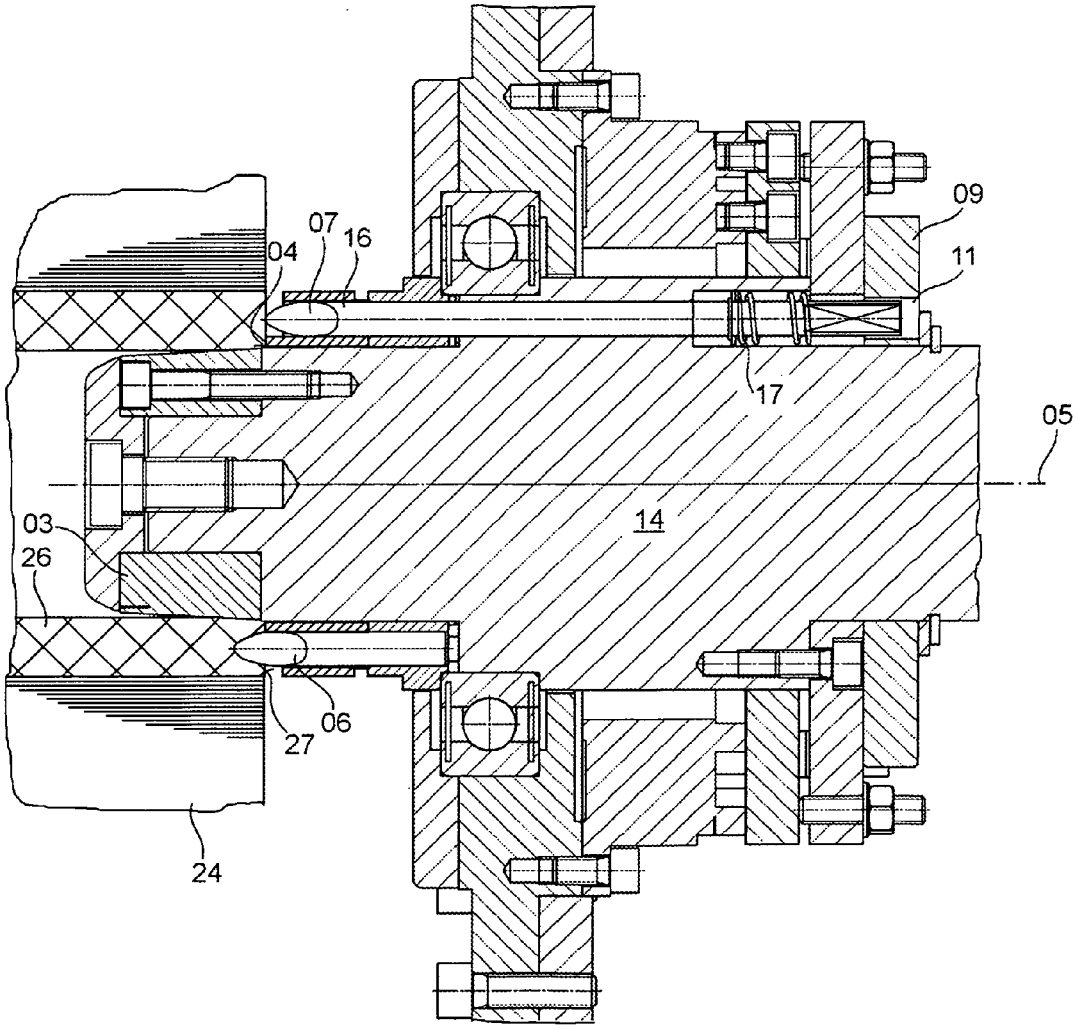
FIG. 6 a longitudinal cross-sectional representation of the clamping cone in a second, passive operating status.

The clamping cone 01 comprises a support journal 03, preferably a support journal 03 having a conical shape and which tapers toward its unattached end. A sleeve mounting surface 04 of an axially shiftable switching ring 10 preferably adjoins the support journal 03, and extends outward, transversely to a longitudinal axis 05 of the cone. In a starting position, which is not specifically depicted, and in which no material reel is loaded onto the reel changer, cutting edges of a plurality of spaced driver elements 06; 07, which are positioned on the clamping cone, are retracted below the sleeve mounting surface 04 of the switching ring 10. This is typically done to prevent accidents. During uploading of a material reel, the axially shiftable switching ring 10 is shifted axially, and essentially is moved parallel with a direction of the rotational axis of the holder 01. As a result of this axial shifting of the switching ring 10, the cutting edges of the driver elements 06; 07 now project out of the sleeve mounting surface 04 of the axially shiftable switching ring 10, as seen in FIG. 1, and can be placed in engagement with the end surface of the material reel sleeve as depicted in FIG. 5. All of the driver elements 06; 07 project out of the sleeve mounting surface 04. These driver elements 06; 07 comprise fixed driver elements 06 and movable, and in particular retractable, driver elements 07. In FIG. 1, the retractable drive elements 07 are shown in their extended positions. In FIG. 2, these retractable drive elements 07 are shown in their retracted positions. In both FIGS. 1 and 2, the axially shiftable switching ring 10 is shifted axially to a position it would occupy if the clamping cone 01 were supporting a winding sleeve, as seen in FIGS. 5 and 6.

During the uploading process, the driver elements 06; 07 are forced into an end surface of a winding sleeve. A primary purpose of these driver elements 06; 07 is to improve torque transmission between the clamping cone 01 and a winding sleeve that is loaded onto a reel changer of which the clamping cone 01 is a part.

The support journal 03 also comprises radial, conically configured driver elements 08, which are pressed into the inner wall of the winding sleeve during uploading. Radial driver elements 08 can also be embodied as radially displaceable clamping jaws.

Figure 3:
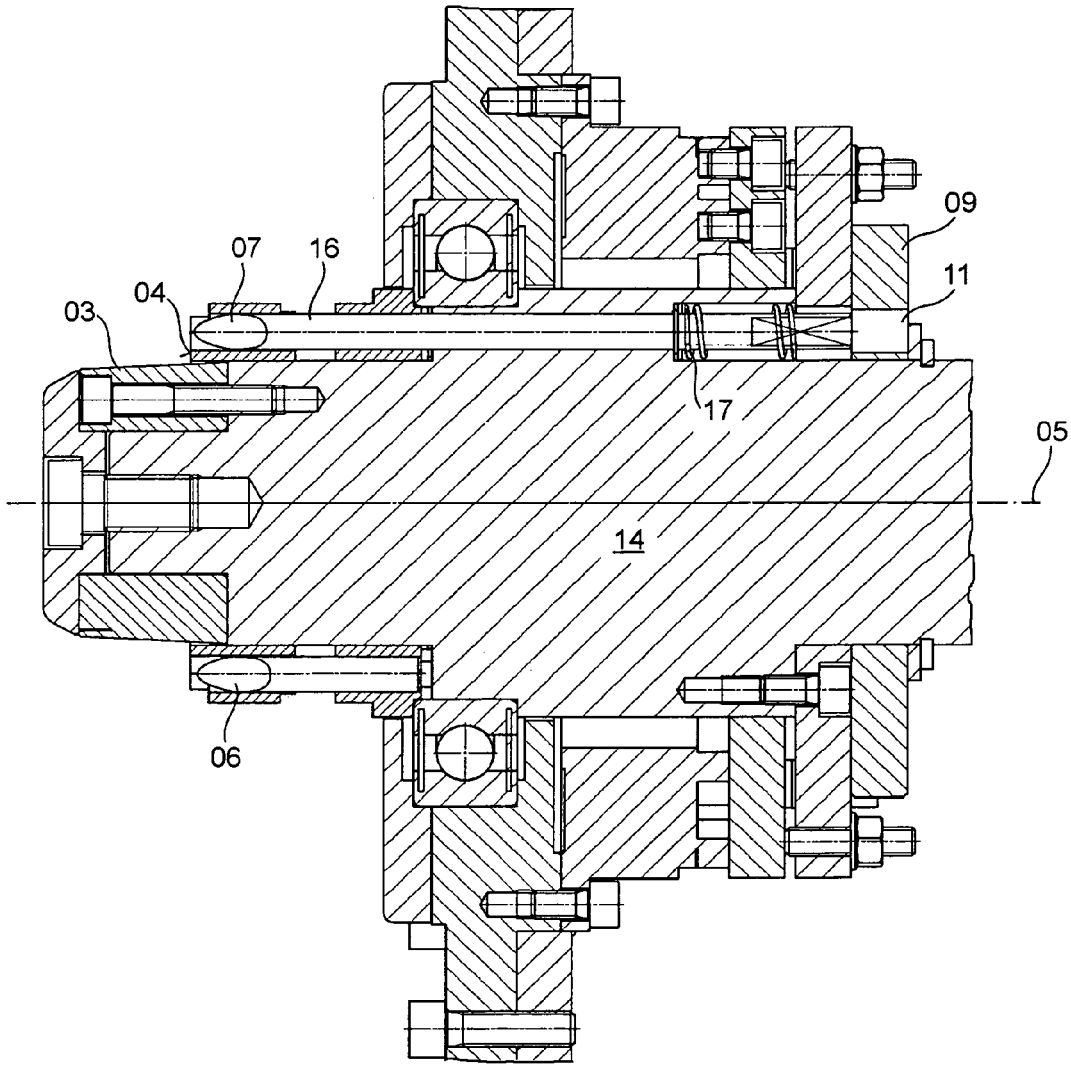
FIG. 3 a longitudinal cross-sectional representation of the clamping cone according to FIG. 2.

Each one of the retractable driver elements 07 is seated in an associated axially aligned, continuous bored hole 16, as may be seen in FIG. 3, each which bored hole 16 is formed in the body 14 of the clamping cone 01. Each such retractable driving element 07 is axially displaceable in its associated bored hole 16.

A rotatable switching element, such as, for example, a rotatable switching ring 09, is rotatably arranged on the shaft 02. The rotatable switching ring 09 has one opening 11 for each retractable driver element 07, each which opening 11 ensures the release or the switch-over of the associated retractable driver element 07 from the active status shown, as depicted in FIG. 1, to a passive status, as seen in FIG. 2. In the active status shown in FIG. 1, the axial movement of the retractable driver element 07 into the interior of the rotationable switching ring 10 is blocked by the position of the rotatable switching ring 09, which, in its active position, covers the opening 11 of the continuous bored hole 16 on the bearing side of the body of the clamping cone; i.e., the side of the clamping cone body 14 adjacent the rotatable switching ring 10.

FIG. 2 shows the passive status of the clamping cone 01. As seen in FIG. 2, in the passive position of the rotatable switching ring 09, the opening 11 in ring 09 is aligned with the bored hole 16 in the body 14 of the clamping cone 01.

In this passive status shown in FIG. 2, the retractable driver element 07 is retracted into the body 14 of the clamping cone 01. Its sharpened point does not project beyond the edge of the sleeve mounting surface 04.

The driver element 07 is retracted by an axial displacement of that driver element 07 when an opening 11 in the rotatable switching ring 09 is located opposite the bearing-side opening of the continuous bored hole 16, as is depicted in FIG. 3. The retractable driver element 07 is then able to yield axially as a winding sleeve is being pushed onto the clamping cone 01. This may be seen most clearly in FIG. 6.

The rotatable switching ring 09 can be fixed in the respectively required position; i.e., in the active status or in the passive status by the use of a locking pin, which is not specifically shown. A stop pin 12 is provided and is usable to limit the rotational movement of the rotatable switching ring 09. The stop pin 12 cooperates with an indentation 13 in the rotatable switching ring 09.

FIG. 3 shows a longitudinal section of the clamping cone 01. In FIG. 3, the axiably shiftable switching ring 10 is shown in its position when no winding sleeve is supported by the clamping cone 01.

In FIG. 3, the seating of the retractable driver element 07 is shown above the longitudinal axis 05. One of the fixed driver elements 06 is shown below the longitudinal axis 05. The axially shiftable switching ring 10 is in its position extending toward the free end of the support journal 03 so that the winding sleeve engaging tips or ends of both the fixed driver elements 06 and of the retractable driving elements 07 are not extending beyond the sleeve mounting surface 04.

The longitudinal axis 05 of the clamping cone 01 is also the rotational axis of the shaft 02.

In the preferred embodiment of the present invention, which is shown in the drawings, the body 14 of the clamping cone 01 is embodied as forming a single piece with the shaft 02. However, this body 14 of the clamping cone 01 may also be embodied as a separate part or as a sleeve. In the body 14, a continuous bored hole 16 extending axially is provided for each retractable driver element 07 and in which bored hole 16, each such retractable driver element 07 is seated and is guided so as to be displaceable axially.

At the shaft end or bearing end of the bored hole 16, the rotatable switching ring 09 is located. As has been discussed above, depending upon the rotational position of this rotatable switching ring 09, it can either block or allow the axial movement of the retractable driver element 07. The blocked position of the retractable driver element 07 is shown in FIG. 5. Its retracted position in shown in FIG. 6.

FIG. 3 shows the passive status of the clamping cone 01. In this passive status, the opening 11 of the rotatable switching ring 09 is located opposite the shaft-side or bearing side opening of the bored hole 16 in the clamping cone body 14. Therefore, the retractable driver element 07 is displaceable in the axial direction of the longitudinal axis 06. The retractable driver element 07 is held in the starting position, as shown in FIG. 3 by the force of an element 17, for example a spring 17.

When a winding sleeve 26, that is to be uploaded onto the clamping cone 01, acts on the retractable driver element 07 on the cone side, that retractable driver element 07 yields axially and its end, opposite to its sleeve engaging end, can shift through the opening 11 in the rotatable switching ring 09. The pointed end of the retractable driver element 07 is thereby retracted into the sleeve mounting surface 04. This passive position of the retractable diver element 07 is depicted in FIG. 6. The fixed driver elements 06 protrude out of the sleeve mounting surface 04 of the axially shiftable switching ring 10 which, as seen in FIG. 6, has been shifted to the right by its engagement with an end surface 27 of the winding sleeve 26.

In the clamping cone 01, three retractable driver elements 07, alternating with fixed driver elements 06, can preferably be arranged in a circular pattern These three retractable driver elements 07 can be evenly spaced around the sleeve mounting surface 04.

Figure 4:
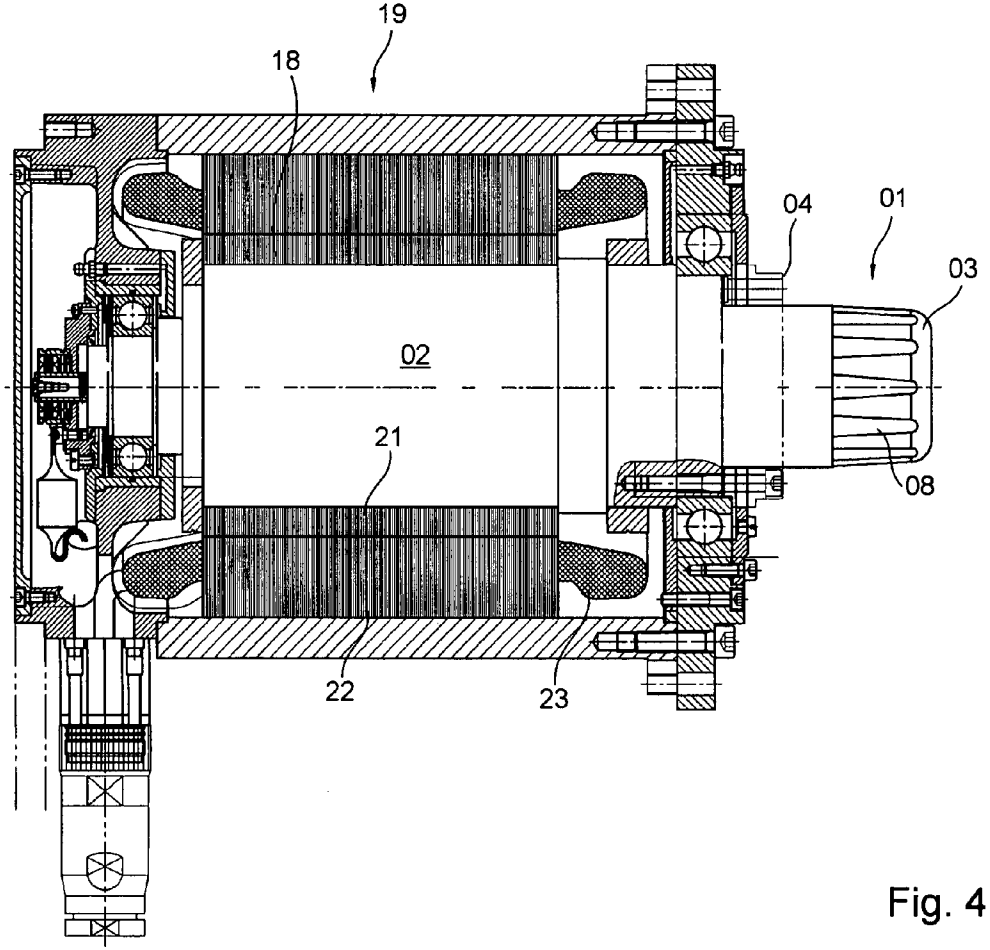
FIG. 4 a cross-sectional representation of an electric motor for driving a reel changer.

FIG. 4 shows an embodiment of a clamping cone 01 in accordance with the present invention and in which the clamping cone 01 is arranged directly on the rotor 18 of a drive motor 19, such as, for example, a synchronous motor 19. The shaft 02 of the synchronous motor 19 projects beyond the housing of the synchronous motor 19 on the side of the motor 19 which is adjacent to the material reel to be uploaded. This projecting end of the shaft 02 serves as a support journal 03, on which the material reel can be rotatably mounted.

The support journal 03, with the radial driver elements 08, is produced from the shaft 02 of the motor 19 using correspondingly appropriate processing methods. This eliminates the need for a separate cone between winding sleeve and drive shaft.

The synchronous motor 19 is embodied as a type of field-weakening synchronous motor 19, which can be operated with field weakening up to a ratio of 1:10. The synchronous motor 19 is equipped with poles 21 and an electric excitation 23, in a generally known manner. Particularly, the rotor 18 of the synchronous motor 19 has poles 21 comprising permanent magnets, and the stator 22 of the synchronous motor 19 has an electric excitation 23. The permanent magnets are preferably embodied as rare earth materials.

The retractable driver elements 07 are not shown in the depiction of the present invention shown in FIG. 4, but can also be provided here directly in the rotor of the synchronous motor 19, as is shown in FIG. 3. The rotatable switching ring 09 can be arranged directly behind the sleeve mounting surface 04.

In another embodiment of the present invention, the clamping cone 01 is driven indirectly by the use of a preferably position-controlled electric motor. This is preferably achieved by the use of a toothed belt.

In a first operating status as depicted in FIG. 5, a first winding sleeve 26 with a first material property or properties, and particularly with a first hardness, and a first active number of the driver elements 06; 07, both retractable and fixed and which engage in the end surface of the first winding sleeve are arranged on the holder. In this first operating status, both the retractable driver elements 07 and the fixed driver elements 06 are inserted into the end surface 27 of the winding sleeve 26. This would be a typical operating status when the sleeve 26 is relatively soft. The rotatable switching ring 09 is in its position in which the retractable driver elements 07 cannot be shifted axially along the longitudinal axis 05 of the clamping cone 01.

In a second operating status, as depicted in FIG. 6, a second winding sleeve 26 with a second material property or properties, and particularly with a second hardness, is arranged on the holder 01. The property or properties of the second winding sleeve 26 depicted in FIG. 6 are different from the material property or properties of the first winding sleeve. Typically, the hardness of the second winding sleeve 26 is greater than is the hardness of the first winding sleeve 26 depicted in FIG. 5.

A second number of active driver elements 06; 07, which engage in the end surface 27 of the second winding sleeve 26, are arranged on the holder of the second winding sleeve. This second number of active driver elements 06; 07, as depicted in FIG. 6, differs from the first number of active driver elements 06; 07 engaging in the end surface of the first winding sleeve as depicted in FIG. 5. In the depiction of FIG. 6, the rotatable switching ring 09 has been placed in its position in which the retractable driver elements 07 are retracted into the body 14 of the clamping cone 01 by having been shifted axially. Such axial shifting of the retractable driver elements 07 is facilitated by the positioning of the rotatable switching ring so that its openings 11 are aligned with the bored holes 16 in the body 14 of the clamping cone 01, which alignment allows the retractable driver elements 07 to be shifted axially by their engagement with the end face 27 of the winding sleeve 26.

While preferred embodiments of a reel changer having a holder for supporting a material reel with a winding sleeve have been disclosed fully and completely hereinabove, it will be apparent to one of skill in the art that various changes and modifications to, for example the structure of the reel changer, the specific structure of the drive motor, the materials used for the material reel and the like, could be made without departing from the true spirit and scope of the present invention which is accordingly to be limited only by the appended claims.

What is claimed is:

1. A reel changer having a holder for supporting a material reel with a winding sleeve, wherein the holder has a support journal and a plurality of driver elements, wherein the driver elements are arranged so as to engage in an end surface of the winding sleeve, characterized in that the plurality of driver elements engaging in the end surface of the winding sleeve can be varied by axially retracting one or more driver elements while maintaining engagement with the end surface of the winding sleeve.

2. The reel changer of claim 1, characterized in that in a first operating status, a first winding sleeve having a first material property is arranged on the holder and a first plurality of driver elements are arranged engaged in the end surface of the first winding sleeve, and in a second operating status, a second winding sleeve having a second material property, which is different from the first material property, is arranged on the holder, and a second plurality of driver elements, which is different from the first plurality of driver elements, are arranged engaged in the end surface of the second winding sleeve.

3. The reel changer of claim 1, characterized in that the holder comprises a switching ring with a sleeve mounting surface.

4. The reel changer of claim 3, characterized in that the driver elements are arranged in the holder projecting out of the sleeve mounting surface, at least when the switching ring is pushed back.

5. The reel changer of claim 3, characterized in that at least one of the driver elements can be retracted at least partially into the sleeve mounting surface.

6. The reel changer of claim 1, characterized in that the holder further comprises a switching element which allows at least some of the plurality of driver elements to switch between an active and a passive status.

7. The reel changer of claim 6, characterized in that the switching element is a switching ring which is arranged on the body, wherein by turning the switching ring, at least some of the plurality of driver elements can be switched between the active and passive status, in that a blocking surface limits the axial movement of said driver elements in the active status, and an opening allows the axial movement of said driver elements in the passive status.

8. The reel changer of claim 1, characterized in that each of the driver elements has at least one cutting edge.

9. The reel changer of claim 1, characterized in that three movable ones of said plurality of said driver elements are arranged alternating with fixed ones of said plurality of driver elements in the holder.

10. The reel changer of claim 9, characterized in that the movable ones of said plurality of driver elements can be switched together.

11. The reel changer of claim 1, characterized in that the support journal has additional radial driver elements.

12. The reel changer of claim 11, characterized in that the additional radial driver elements of the support journal are conical.

13. A reel changer having a holder for supporting a material reel with a winding sleeve, wherein the holder has a support journal and a plurality of driver elements, wherein the direction of action of the plurality of driver elements is oriented parallel to a rotational axis of the holder, characterized in that the position of at least one of the driver elements relative to the support journal can be varied by axially retracting said at least one of the plurality of driver elements while maintaining engagement with an end surface of the winding sleeve.

14. The reel changer of claim 13, characterized in that during uploading of a material reel, the driver elements engage in a positive and frictional connection in the end surface of the winding sleeve in an axial direction for transmitting torque.

15. The reel changer of claim 13, characterized in that at least some of the plurality of driver elements (07) are mounted so as to be axially displaceable in a body.

16. The reel changer of claim 15, characterized in that when the holder is in an active status, the axial displacement of some of the plurality of driver elements is blocked.

17. The reel changer of claim 15, characterized in that the one or more of said axially displaceable driver elements are flattened at their ends that are located in the body, wherein the flattened end is guided by at least one guide edge.

18. The reel changer of claim 13, characterized in that when the holder is in a passive status, at least some of the plurality of driver elements are arranged so as to yield to the winding sleeve during uploading of the material reel.

* * * * *